US006598356B1

(12) United States Patent
Sells

(10) Patent No.: US 6,598,356 B1
(45) Date of Patent: Jul. 29, 2003

(54) INSULATED ROOFING SYSTEM HAVING A FORM-FITTING COMPRESSIBLE SEAL AND VENTILATION

(75) Inventor: Gary L. Sells, Mishawaka, IN (US)

(73) Assignee: Cor-A-Vent, Inc., Mishawaka, IN (US)

( * ) Notice: Subject to any disclaimer, the term of this patent is extended or adjusted under 35 U.S.C. 154(b) by 0 days.

(21) Appl. No.: 10/175,631

(22) Filed: Jun. 20, 2002

(51) Int. Cl.[7] ..... E04B 7/02

(52) U.S. Cl. ..... 52/90.1; 52/95; 52/198; 52/199

(58) Field of Search ..... 52/90.1, 57, 95, 52/198, 199

(56) References Cited

U.S. PATENT DOCUMENTS

| | | | | |
|---|---|---|---|---|
| 3,394,516 A | | 7/1965 | Taylor et al. | |
| 4,017,090 A | | 4/1977 | Cohen | |
| 4,047,346 A | * | 9/1977 | Alderman | 52/407.4 |
| 4,058,949 A | * | 11/1977 | Bellem | 52/407.1 |
| 4,346,543 A | | 8/1982 | Wilson et al. | |
| 4,573,291 A | | 3/1986 | Hofmann | |
| 4,622,789 A | | 11/1986 | Quinnell | |
| 4,651,489 A | | 3/1987 | Hodges et al. | |
| 4,724,278 A | | 2/1988 | Smith | |
| 4,791,770 A | | 12/1988 | Bell, III et al. | |
| 4,920,721 A | | 5/1990 | Pressutti et al. | |
| 4,951,664 A | | 8/1990 | Niemeyer | |
| 5,092,225 A | * | 3/1992 | Sells | 454/365 |
| 5,328,407 A | * | 7/1994 | Sells | 454/365 |
| 5,427,571 A | | 6/1995 | Sells | |
| 5,473,847 A | | 12/1995 | Crookston | |
| 5,493,819 A | | 2/1996 | Acosta-Torres | |
| 5,495,698 A | | 3/1996 | Alderman et al. | |
| 5,542,882 A | * | 8/1996 | Sells | 454/365 |
| 5,830,059 A | * | 11/1998 | Sells | 454/365 |
| 5,921,863 A | * | 7/1999 | Sells | 454/359 |
| 6,131,353 A | * | 10/2000 | Egan | 52/408 |
| 6,213,868 B1 | * | 4/2001 | Sells | 454/359 |
| 6,267,668 B1 | | 7/2001 | Morris | |
| 6,308,472 B1 | * | 10/2001 | Coulton et al. | 52/198 |
| 6,361,434 B1 | * | 3/2002 | Brandon | 454/365 |
| 6,450,882 B1 | * | 9/2002 | Morris et al. | 454/365 |

OTHER PUBLICATIONS

Photograph, Metal Construction News, Mar. 2002, p. 39.
Photographs, "Coming in May 2002 . . . ", undated.
Advertisement, "Medallion I et al.", undated.
Advertisement, Thermal Design, Inc., "Sports Interiors", May 1998, 4 pages.

* cited by examiner

*Primary Examiner*—Carl D. Friedman
*Assistant Examiner*—Nahid Amiri
(74) *Attorney, Agent, or Firm*—Baker & Daniels

(57) ABSTRACT

A roofing ventilation system for a metal building. The system includes a compressible seal between a corrugated sheet metal roof and a roof vent of the system. Further, the present invention utilizes an insulating block having venting capability in order to allow moisture and hot air in the roofing system to escape, thereby reducing corrosion of the metal roof and deterioration of the insulating ability of the insulation material. In one embodiment, the system includes a shield between the insulating vent block and insulation material, such that insulation adjacent a compressed area of material does not obstruct the air passages of the insulating block. In one embodiment of the present invention, the compressible seal is a sealing strip that conforms to the profile and shape of the corrugated roof. The sealing strip is formed from an open-celled foam material and has a plurality of slits to provide an environmental barrier across the length of the corrugated roof. In an embodiment of the present invention, two ventilation strips are aligned along a ridge opening in the roof in an effort to vent air and evacuate moisture from the system that has transferred through one or more insulating vent blocks.

31 Claims, 21 Drawing Sheets

INSULATED ROOFING SYSTEM HAVING A FORM-FITTING COMPRESSIBLE SEAL AND VENTILATION

BACKGROUND OF THE INVENTION

The present invention relates to an insulated roofing system including vents and a compressible seal. More particularly, this invention is for use with corrugated metal buildings and includes vents interposed between a metal roof and roof purlins that support the roof. Additionally, the roofing system includes compressible closure strips for use in sealing between a ridge vent and roofing panels having various corrugated contours.

Insulated roofing systems for use with building structures have been known for many years. It is well known to provide an insulation blanket beneath a metal roof. In a typical arrangement, the insulation is placed between the metal roof and a structural member, such as a Z-shaped steel purlin, in an effort to thermally insulate the interior of the structure from the thermally conductive metal roofing. Moreover, the need to insulate the interior of a structure having a thermally conductive metal roofing becomes especially important during a temperature extreme, such as a hot, sunny, summer day or a cold, windy, winter night. The need for insulation becomes even greater when the rising cost of utilities is considered, such as the cost of electricity required to run air conditioning units in order to cool the structure, and the cost of natural gas used by furnaces and the like, for the heating of the structure.

Traditional insulation for metal roofing has been carried out by placing a layer of thick roll insulation, such as fiberglass, beneath the roof. The insulation is supported by laying it over the top of roofing frame members or purlins that support the roofing system over the building structure. The roll insulating material should be of sufficient thickness to retard heat flow through the thermally conductive metallic roof. Unfortunately, in traditional roofing systems, the insulating material is often compressed between the sheet metal roofing and the purlin supports of the roofing system, resulting in a loss of thickness in the insulating material and consequently a reduction of the insulation efficiency of the insulation material.

In recent years, it has been attempted to solve the above problem of insulation material compression through the addition of an insulated block where the roof support contacts the metal roofing. Such an insulation block is shown in U.S. Pat. No. 4,651,489 to Hodges, et al., incorporated herein by reference. The rolled insulation may also be cut or positioned around the insulating block to prevent the rolled insulated material from being compressed, such as is shown in U.S. Pat. No. 4,346,543 to Wilson, et al. and U.S. Pat. No. 5,495,698 to Alderman, et al., both incorporated herein by reference. This helps the rolled insulating material to maintain a constant thickness throughout to provide an efficient insulation blanket. It has also been known to incorporate metallic spacers or brackets for reducing the compression of the insulation between a metal roof and roofing frame members as is shown in U.S. Pat. No. 3,394,516 to Taylor, et al. and U.S. Pat. No. 4,791,770 to Bell III, et al., both incorporated herein by reference.

Unfortunately, while this construction constitutes a considerable improvement in regard to the use and thermal efficiency of insulation in a roof structure, it is not without limitations. Moisture may become trapped in the space between the metal roof and the insulation when using prior art thermal insulation blocks as these blocks do not facilitate movement and removal of air from this space. Trapped moisture can have an extremely adverse effect on the thermal efficiency and life of the insulation material and may corrode the metal roof.

Additionally, in a roofing system as described above, the metallic roof will often be corrugated, having many peaks and valleys of various magnitudes. Typically, a ventilation system is mounted to the corrugated roof over an opening in the roof so that moisture and hot air may freely escape the roofing structure. The ventilation is often affixed to the upper portions or peaks of the corrugated roof. Often the ventilation material is relatively stiff and planar, thereby forming unprotected openings between the vent and roof wherever the contour of the corrugated roof descends from a peak. If left unprotected, moisture, debris and other contaminants may penetrate through these openings and enter the building. This problem has been addressed in recent years through the use of closure or sealing strips. However, because there are numerous corrugated roof configurations, the sealing strips must often be cut or formed to match the particular profile of the corrugated roof. Custom matching the sealing strips to the roof configuration increases the cost and makes it more difficult to stock sealing strips that will match a variety of corrugated roof configurations.

SUMMARY OF THE INVENTION

It is an object of the present invention to provide a roofing ventilation system for a metal building. Compressible closure strips are used to seal between corrugated sheet metal roofing and a roof vent of the system. Further, the present invention utilizes an insulating block located beneath the roof and having venting capability in order to allow moisture and hot air in the roofing system to escape.

In one embodiment of the present invention, the system includes a shield between the insulating vent block and insulation material, such that insulation adjacent a compressed area of material does not fluff or billow over air passages of the insulating block. This aids in keeping the vent unobstructed so that trapped moisture may be evacuated from the system.

A versatile sealing strip is provided in an embodiment of the present invention for sealing the area between a corrugated roof and the ventilation system regardless of the profile and shape of the corrugated roof. To these ends, a sealing strip formed from an open-celled foam material and having a plurality of slits allows for a good seal across the length of the roofing ventilation system. Further, the foam seal is sufficiently compressible in order to allow for a good seal at the highest peaks of the corrugated roof (where the distance between the roofing and the ventilation member is smallest), yet still reach the deepest valleys (where the distance between the roofing and ventilation member is greatest). The slits allow the foam seal to more readily mold itself to the contours of the corrugated roof surface, thereby increasing the effectiveness of the seal.

In an embodiment of the present invention, two ventilation strips are aligned along a ridge opening in the roof in an effort to vent air and evacuate moisture from the system that has transferred through one or more insulating vent blocks.

Further, it is the object of the present invention to provide protection to the inner building structure from the elements, helping to maintain a desirable temperature in the interior of the structure and further, keeping undesirable elements, such as rain, wind and snow, outside the structure.

These and other features of the invention will become more apparent and the present invention will be better understood upon consideration of the following description and the accompanying drawings herein.

DETAILED DESCRIPTION OF THE EMBODIMENTS OF THE INVENTION

Figure 1:
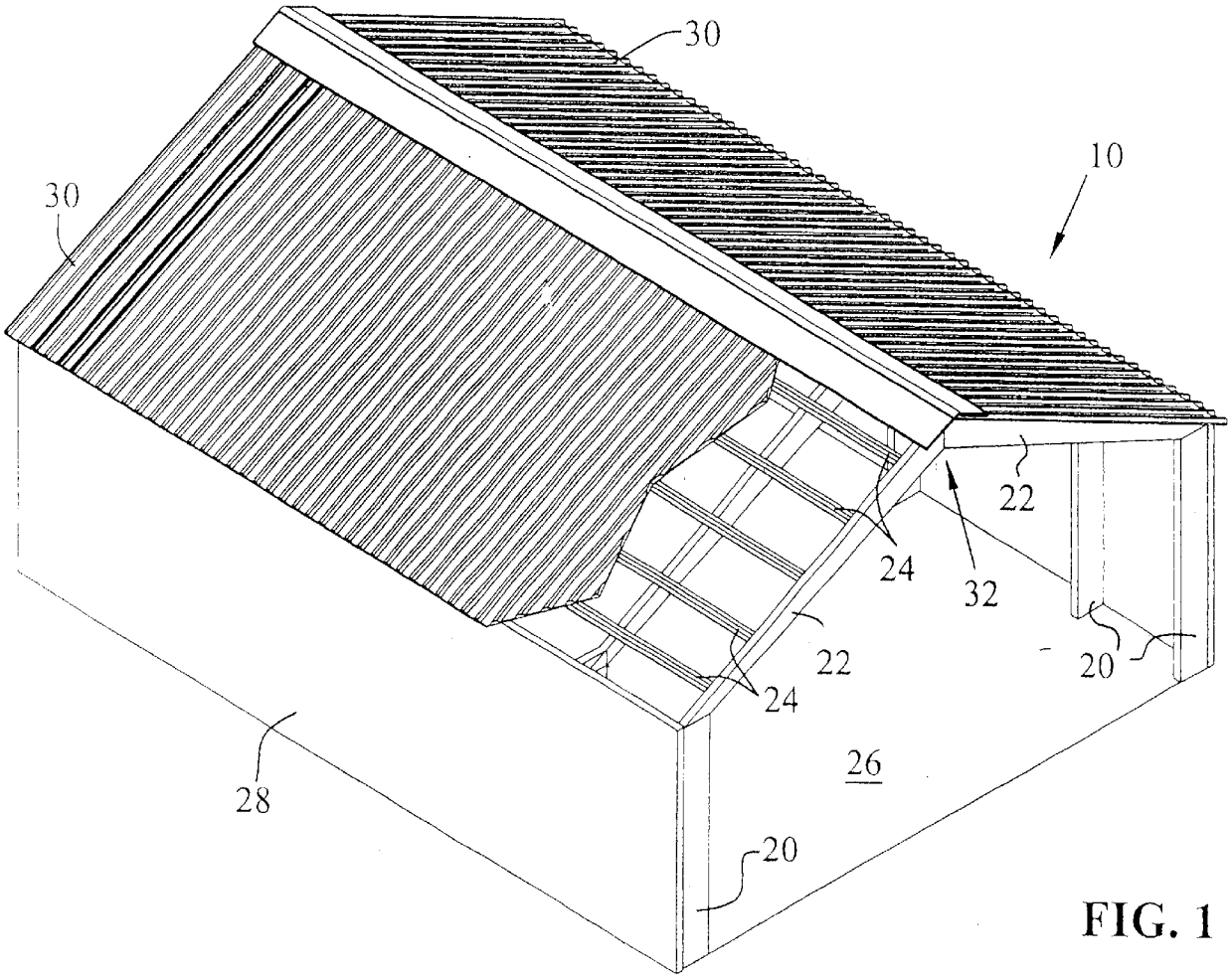
FIG. 1 is a perspective view of a typical shell and support structure of a metal building, wherein the present invention would be incorporated.
Figure 2:
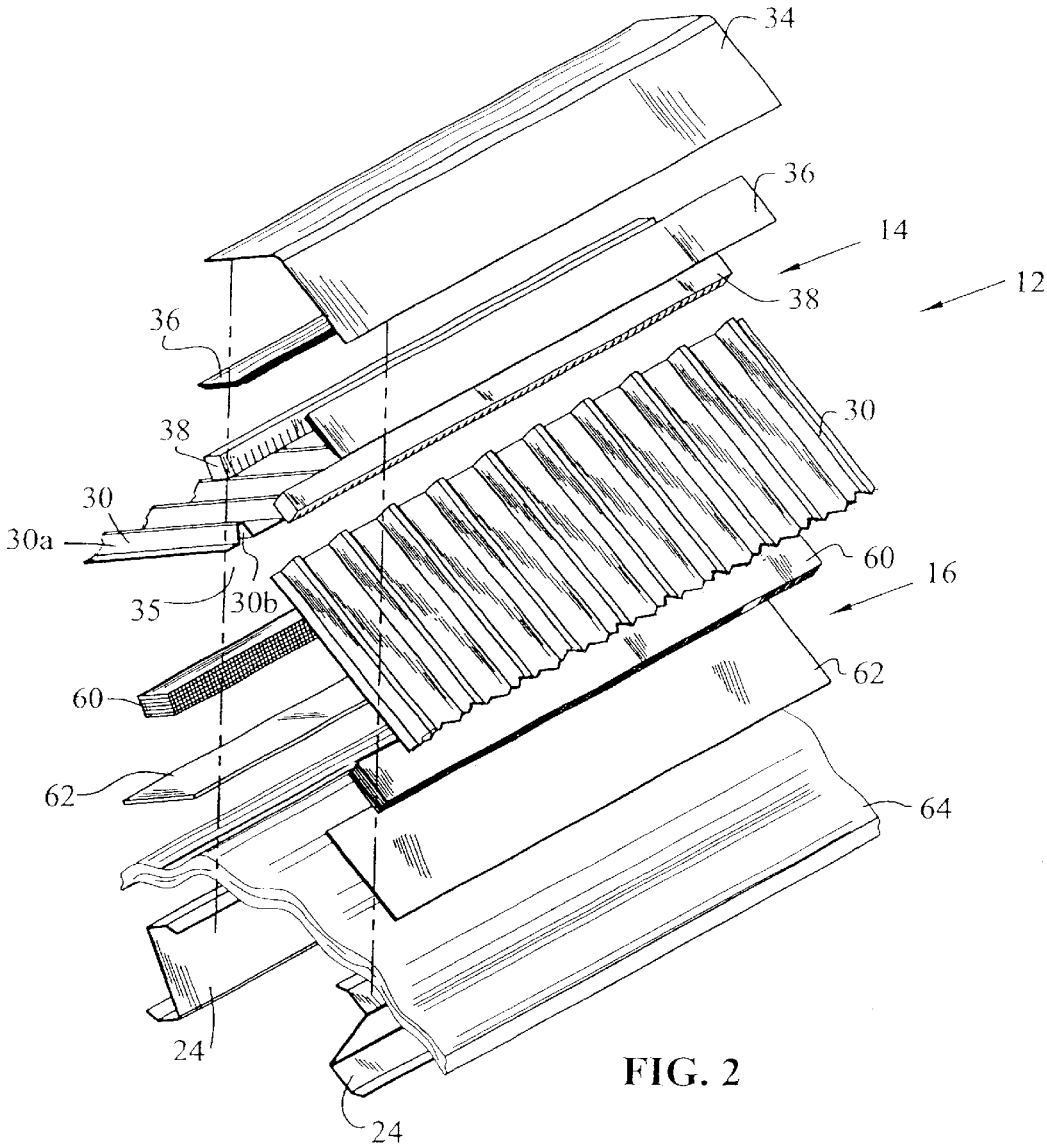
FIG. 2 is an exploded perspective view of an insulated roofing system showing a compressible seal and insulating purlin vent blocks.
Figure 3:
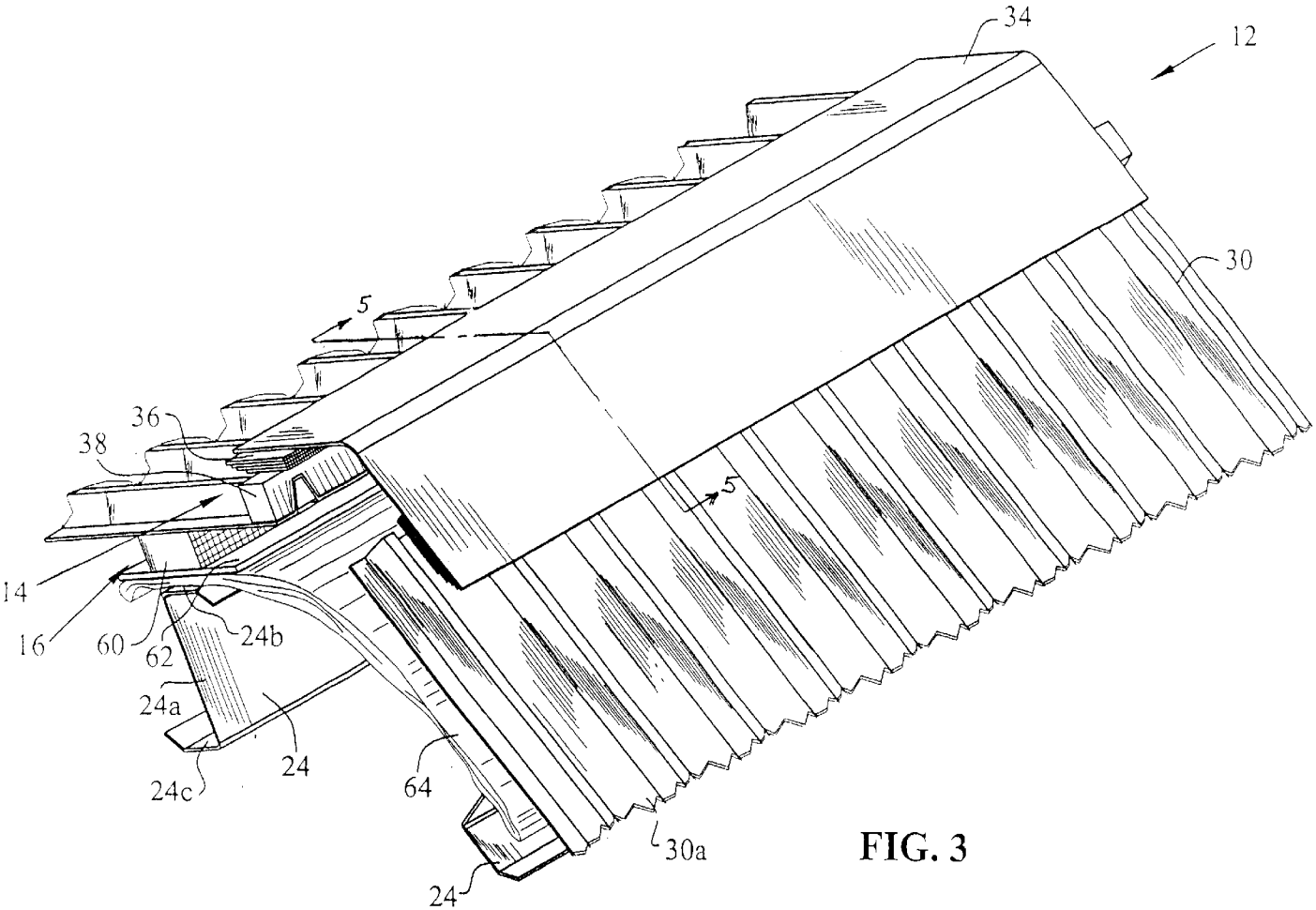
FIG. 3 is an assembled perspective view of the insulated roofing system of FIG. 2.

The present invention is for use with a metal building generally indicated as 10 in FIG. 1. The invention is directed toward a roofing system generally indicated as 12 for use on the metal building 10, wherein the roofing system 12 includes an upper venting region generally indicated as 14 and a lower venting region generally indicated as 16 (FIGS. 2–8).

As shown in FIG. 1, structural support for metal building 10 is provided by a plurality of vertical frame columns or posts 20, rafters 22, and purlins or roof mounting members 24. Building 10 also includes a floor 26, side walls 28, and a corrugated roof 30 which meets at a ridge or peak generally indicated as 32 along the center of building 10. Vertical posts or columns 20 are disposed generally around the periphery of floor 26, and support rafters 22, which span the building at an incline and meet in the center forming peak 32. Purlins 24 are mounted generally perpendicular to rafters 22 and form the support for corrugated roof 30. Side walls 28 are mounted to and supported by frame columns 20.

Figure 5:
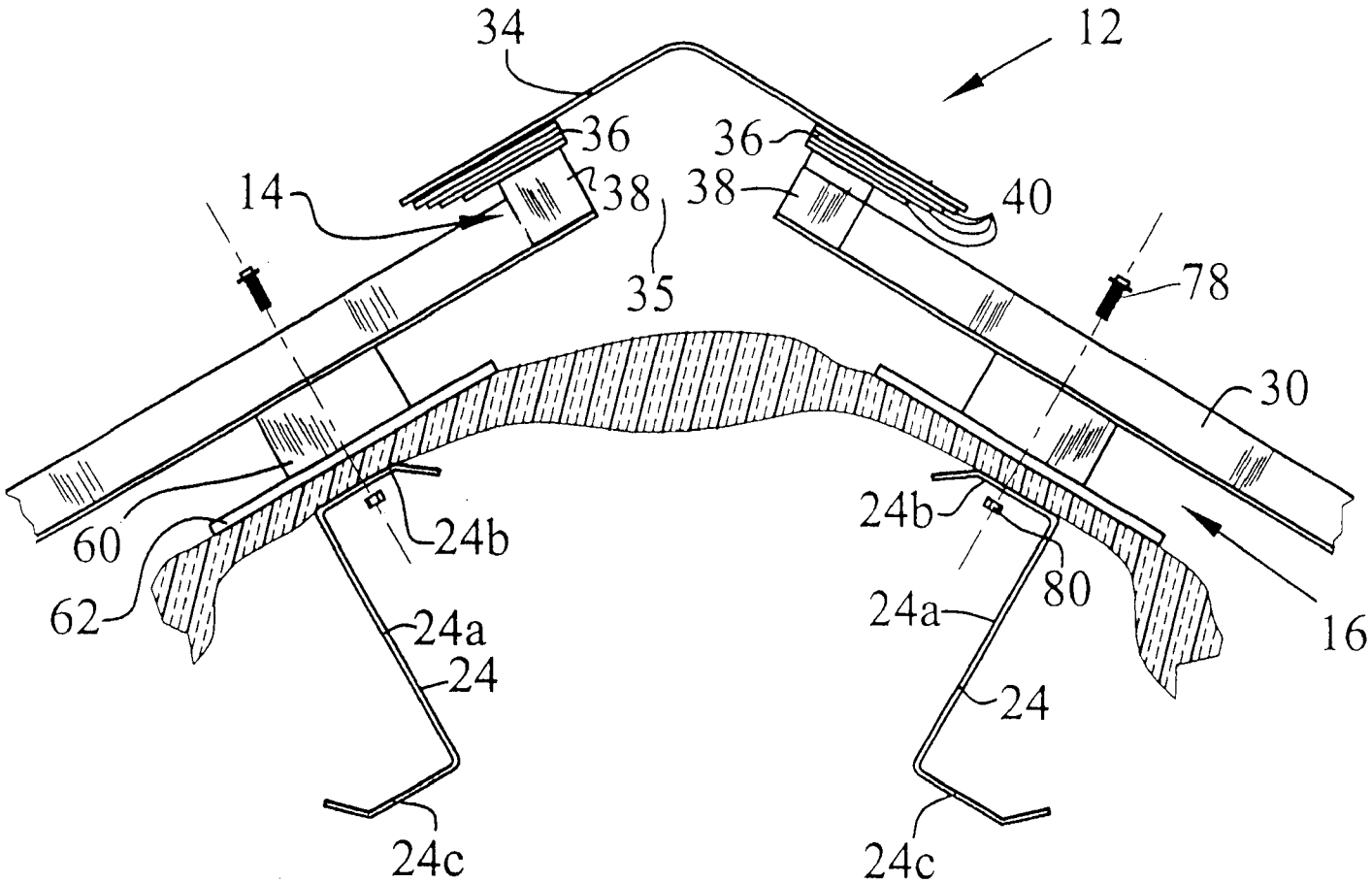
FIG. 5 is a cross-sectional view through the insulated roofing system taken along line 5—5 of FIG. 3.
Figure 6:
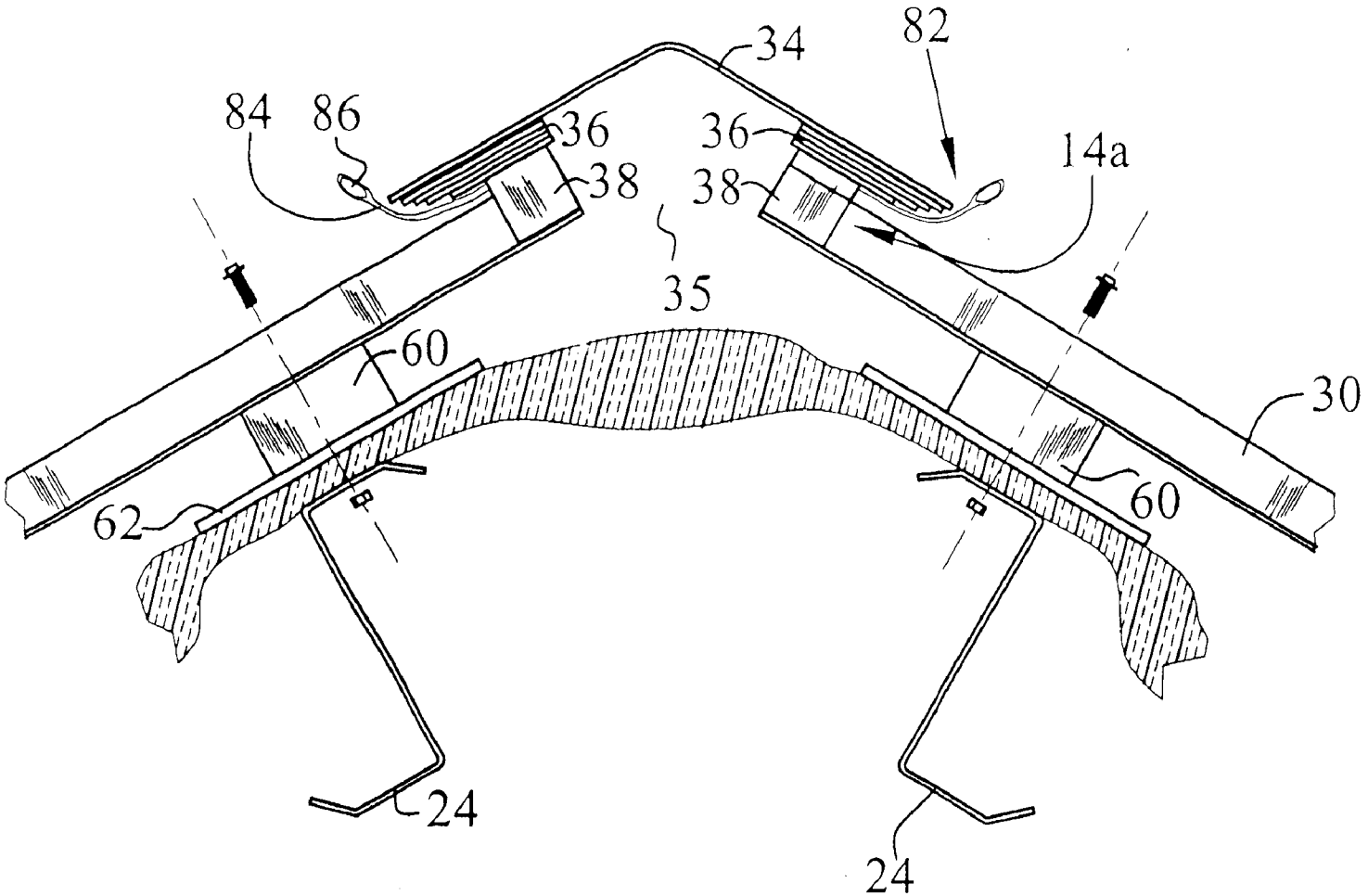
FIG. 6 is a cross-section taken in the same location as FIG. 5 showing an alternate embodiment of the invention with a movable valve member to close the ridge cap vent.
Figure 7:
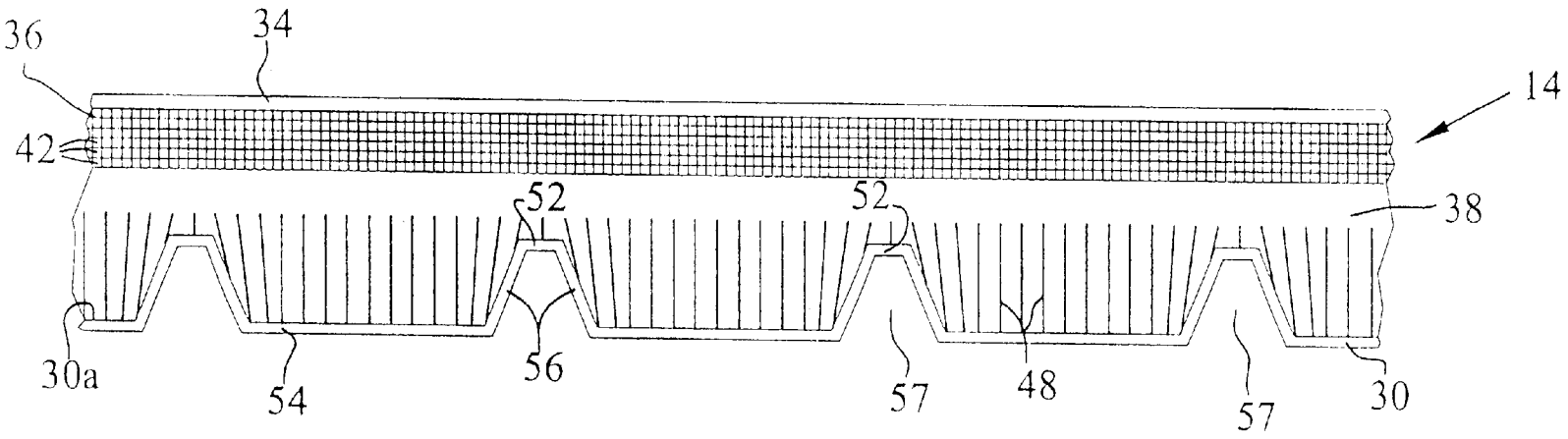
FIG. 7 is a side view along the top side of the roofline of the corrugated roof showing the compressible seal as installed and compressed on a typical corrugated roof.

Now referring to FIGS. 2–7, upper venting region 14 includes a top side 30a of corrugated roof 30, a ridge cap 34, a longitudinal ridge opening 35 along peak 32, vent or ventilation members 36 and compressible seal members 38. Referring to FIG. 7, a typical configuration of corrugated roof 30 includes a plurality of peaks 52, valleys or low regions 54, and sloped regions or declines 56, which connect peaks 52 and valleys 54. Peaks 52 and sloped regions 56 of corrugated roof 30 define regions 57 beneath the peaks. The configuration shown provides strength and bending resistance to the roof as is well known.

Ridge cap 34 is well known in the art and typically manufactured from a sheet metal or plastic material. Vent members 36 are also well known and, in the embodiment shown, are constructed from a plurality of corrugated layers 40 (FIG. 5) that define a plurality of narrow elongated air passages or vent openings 42 (FIG. 7), which extend transverse to peak 32 and ridge opening 35. A more detailed description of one embodiment of vent members 36 is found in U.S. Pat. No. 3,949,657 issued to Applicant herein, entitled "VENTILATION CAP FOR THE RIDGE OF THE ROOF," which is incorporated herein by reference.

Figure 9:
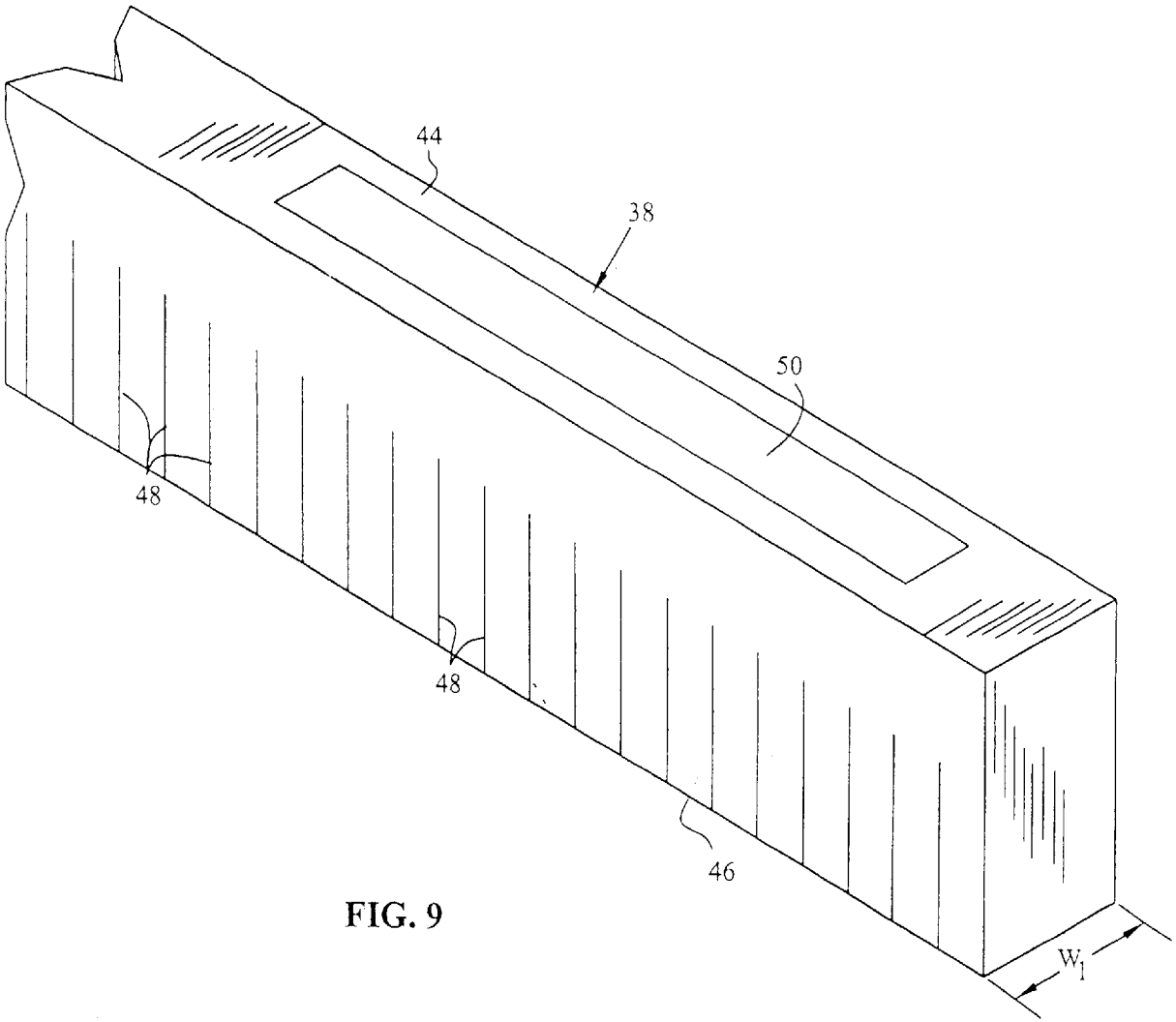
FIG. 9 is a perspective view of an isolated compressible seal member.
Figure 9A:
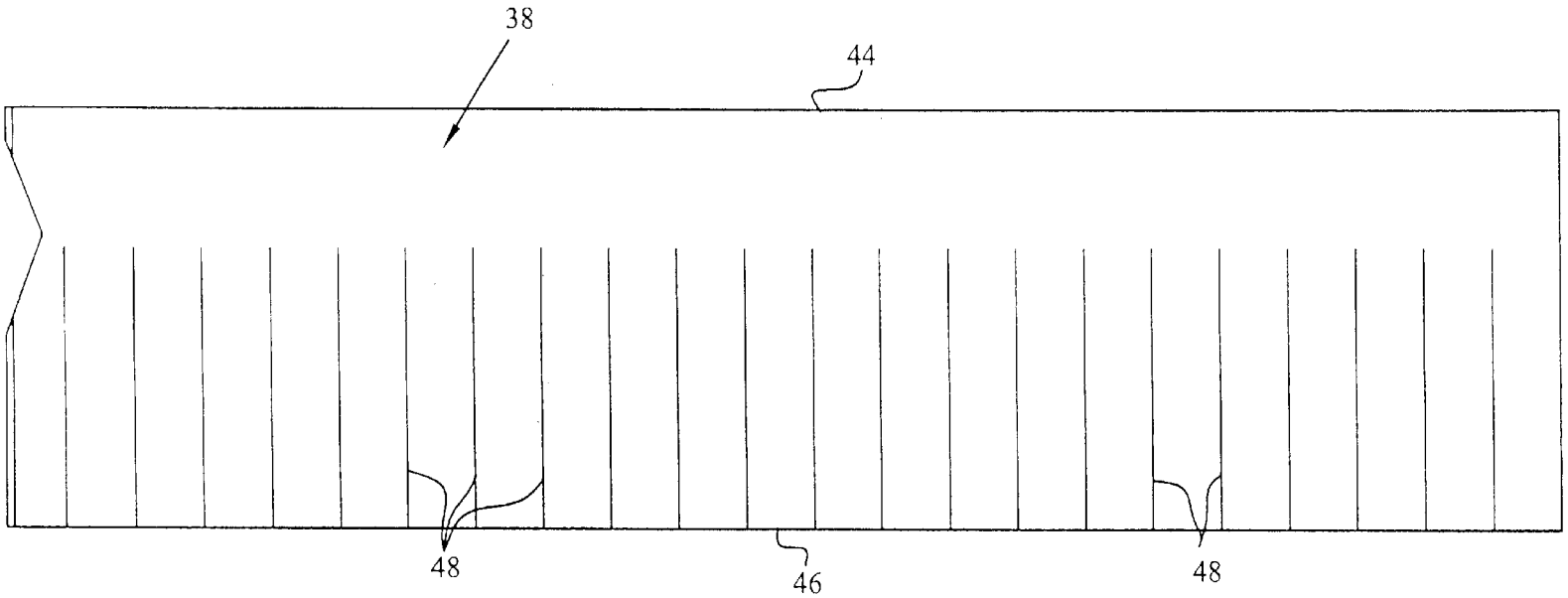
FIG. 9A is a side view of a compressible seal of FIG. 9.

In the embodiment shown, compressible seal members 38 have a generally square or rectangular cross-section and extend longitudinally adjacent ridge opening 35. As best shown in FIGS. 9 and 9A, compressible seal members 38 have a top surface 44, a bottom surface 46, and a plurality of slits 48. Slits 48 extend across the width $W_1$ of compressible seal members 38 severing the bottom surface 46 and extending upwardly therefrom generally parallel to one another. The slits 48 stop short of top surface 44. Compressible seal members 38 may also include an adhesive material 50 along all or a portion of top surface 44 for reasons which are described below. In one embodiment, compressible seal members 38 are formed from an open-celled foam material, which is well known.

Figure 4:
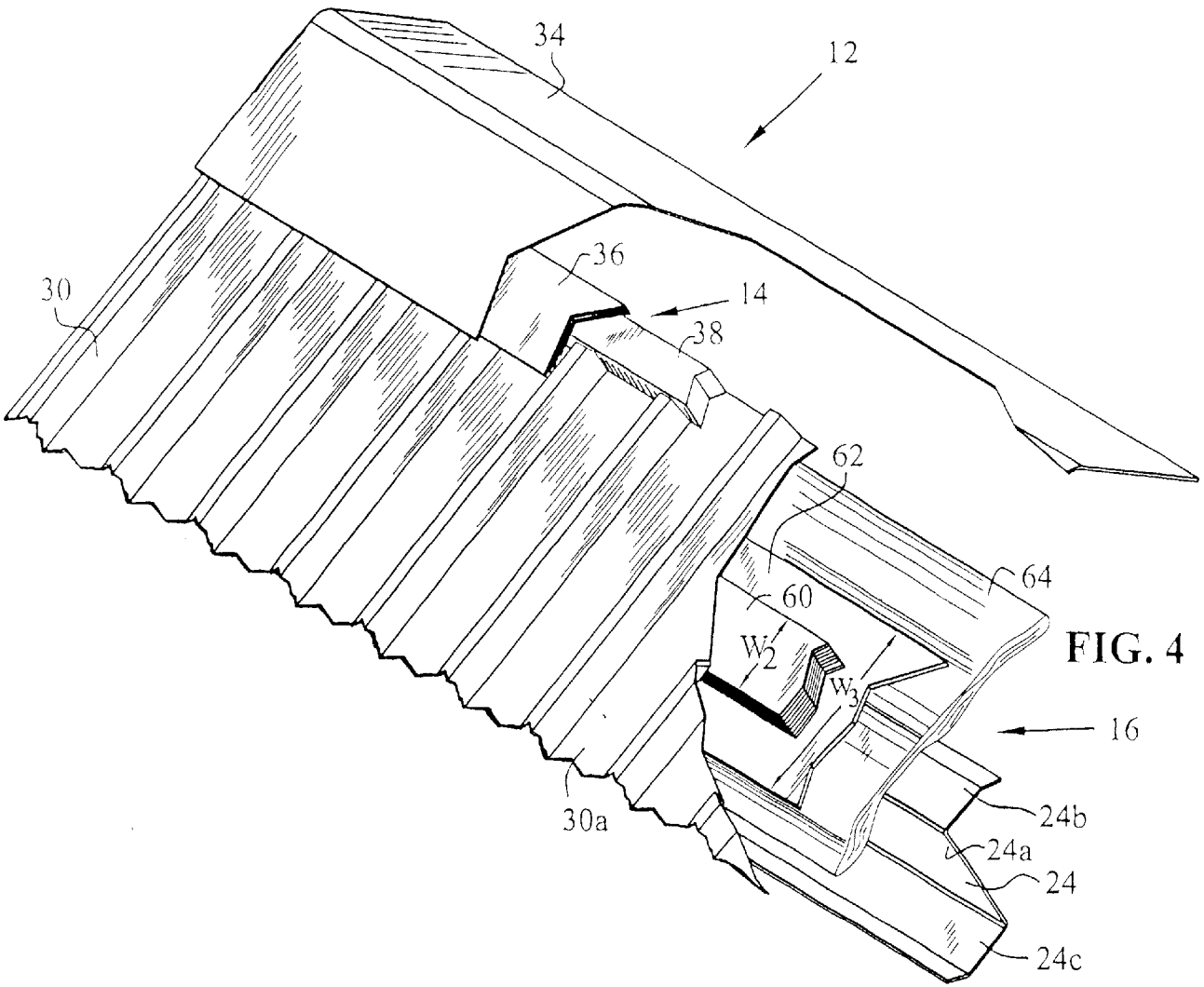
FIG. 4 is a close-up perspective view of the insulated roofing system with portions of the components removed to show the layering arrangement of the components.

Referring again to FIGS. 2–6 and 8, lower venting region 16 of roofing system 12 includes an underneath side 30*b* of corrugated roof 30, a plurality of insulating vent blocks 60, shields 62, rolled or blanket insulation 64, and the purlins 24. Corrugated roof 30 is configured as discussed above and is supported by purlins 24. In a typical structure, as shown in FIG. 5, purlins 24 have a generally Z-shaped configuration including a central web portion 24*a*, an upper leg 24*b*, and a lower leg 24*c*.

Figure 10:
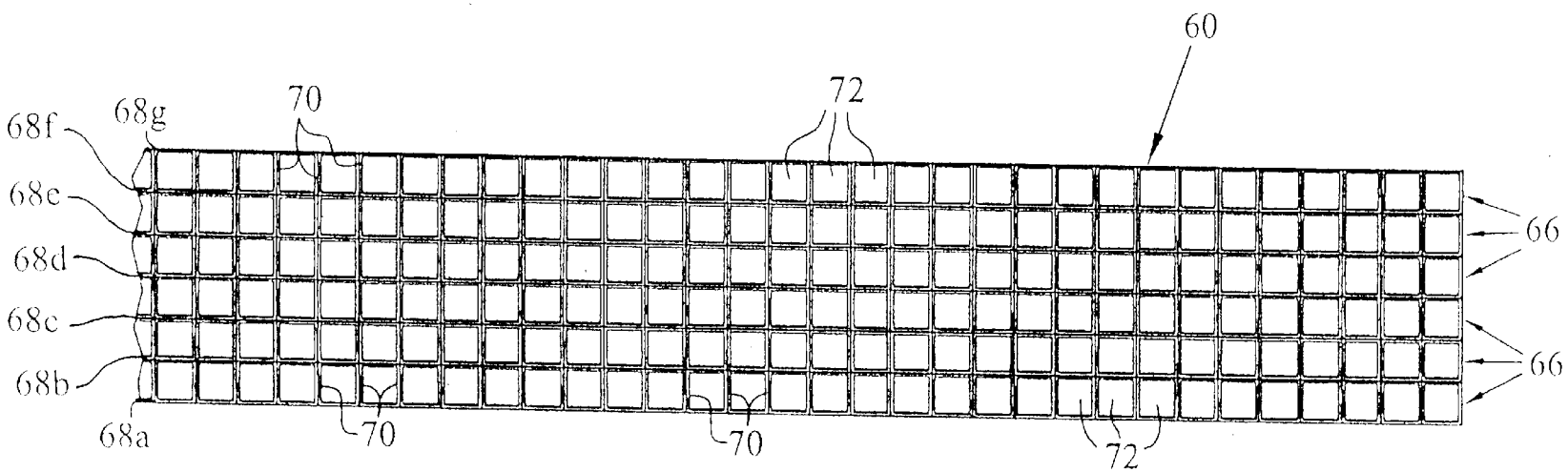
FIG. 10 is a perspective view of an isolated insulating purlin vent block.
Figure 11:
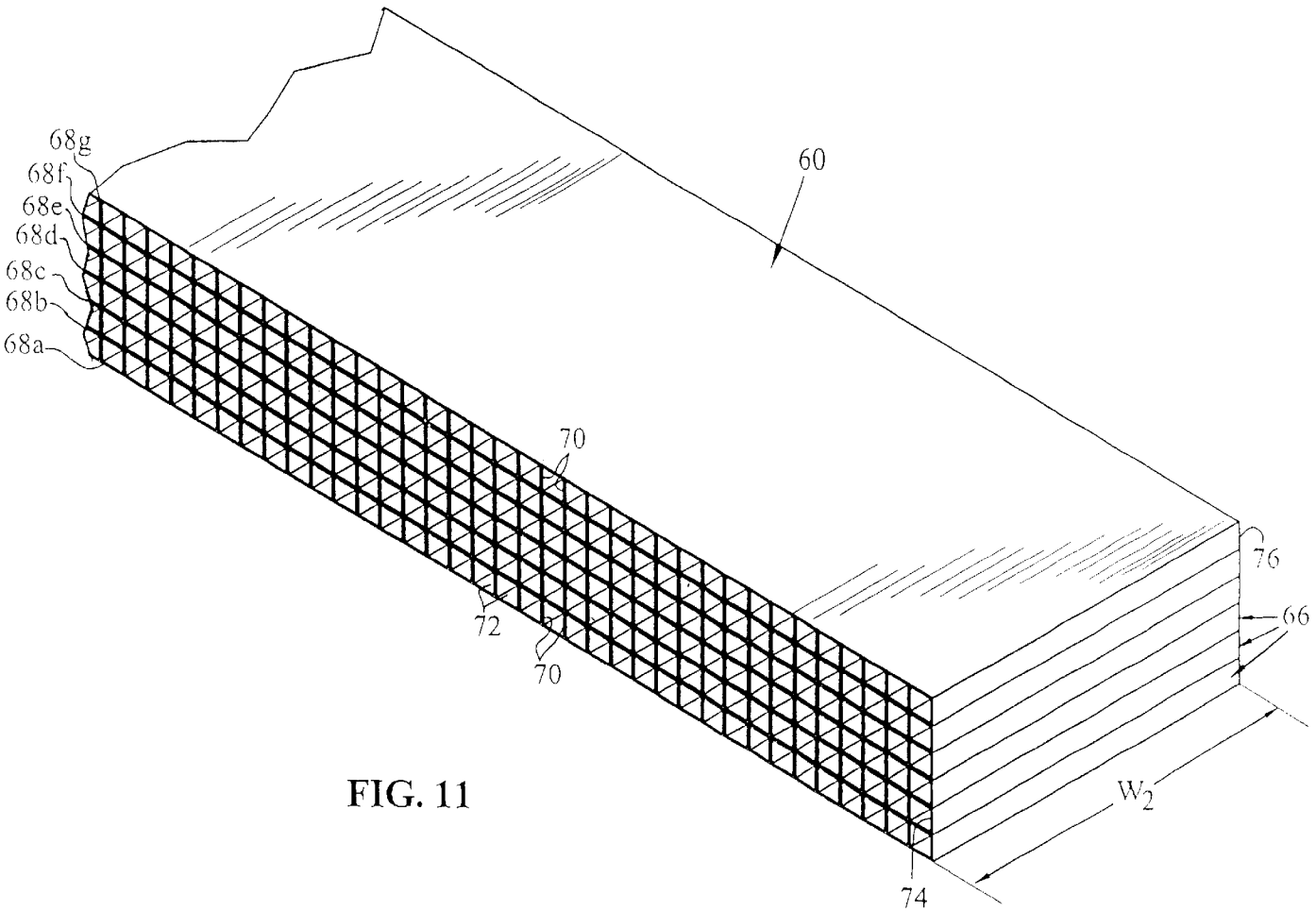
FIG. 11 is a side view of the insulating vent block of FIG. 10.

An embodiment of insulating vent blocks 60 is detailed in FIGS. 10 and 11. This vent block includes a number of layers generally indicated as 66 defined by a plurality of planar plies 68*a*–68*g*. Extending between the plies, generally perpendicular thereto, is a plurality of cross plies typically represented as 70. Planar plies 68*a*–68*g* and cross plies 70 form a plurality of generally square or rectangular airways or passages typically represented as 72 that extend across the width $W_2$ of the vent block and allow air and moisture to be transferred from one side 74 of the vent blocked out the other side 76 and vice versa. It should be noted that planar plies 68a and 68g serve as the lower and upper support surfaces, respectively, for insulating vent blocks 60. In one embodiment, insulating vent blocks 60 are manufactured from extruded polypropylene.

Shield 62 is an optional member for use with the invention as will be described in more detail below, and may be made from one or more extruded layers of polypropylene as with vent blocks 60. In this configuration, each layer has a pair of planar plies similar to plies 68 of the vent blocks and cross plies 70. In the preferred embodiment, shield 62 has a width $W_3$ that is wider than width $W_2$ of insulating vent blocks 60, as is shown in FIG. 4, for reasons discussed below.

Lower venting region 16 may be held together with bolts 78 and nuts 80 (FIG. 5) or other suitable means that are well known.

To assemble the roofing system 12, purlins 24 are mounted to rafters 22 with bolts and nuts, screws, brackets, by welding, or other means well known in the metal building industry. Next, insulation 64 is rolled or otherwise placed over the top of the purlins and supported by the upper legs 24*b* of the purlins. In a typical installation, the insulation is laid transverse to the purlins. It is also common to include a sheet of plastic (not shown) or other material beneath insulation 64 to improve the appearance of the roof, to form a moisture barrier, and to provide additional support for the insulation between the purlins. If shields 62 are used, a shield will be placed between the blanket of insulation 64 and each insulating vent block 60. It should also be appreciated that either the insulating vent blocks or shields may contain an adhesive (not shown) on one or both mating surfaces to facilitate the ease of assembly by holding the vent block and shield together during installation.

The insulating vent blocks 60 and shields 62 are then held in place by laying the corrugated roof 30 over top thereof, and securing the roof, insulating vent blocks 60, and shields 62 to the upper legs 24*b* of purlins 24 using bolts 78 and nuts 80.

Figure 8:
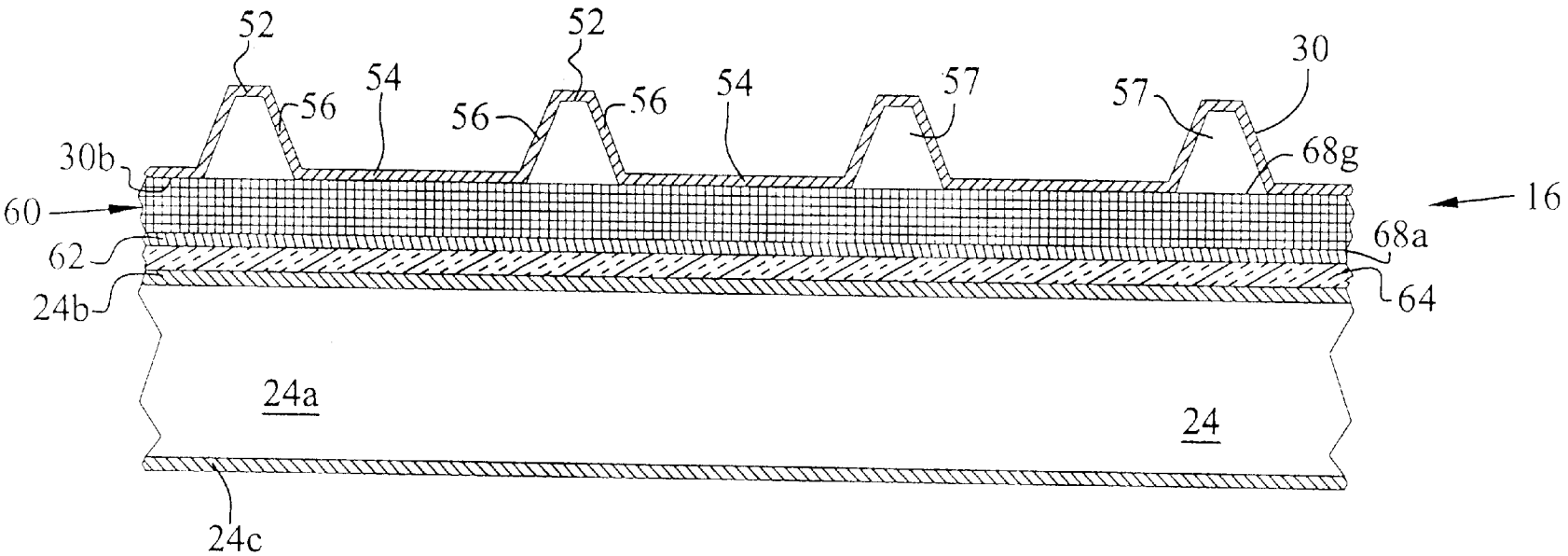
FIG. 8 is a side view along the bottom side of the roofline showing an insulating purlin vent arrangement.

As is best shown in FIG. 8, when lower venting region 16 is assembled, low regions 54 of corrugated roof 30 will be supported upon upper planar ply 68*g* of vent block 60, and lower planar ply 68*a* of the vent block will be supported upon the upper surface of shield 62.

The upper venting region 14 is assembled by placing compressible seal members 38 upon the top side 30*a* of corrugated roof 30. One compressible seal is placed adjacent each side of ridge opening 35, with the bottom surface 46 of compressible seal 38 contacting top surface 30*a*, such that slits 48 are facing down to corrugated roof 30. A vent member 36 is then placed over each compressible seal 38 as shown in the drawings and covered with a ridge cap 34. It should be noted that the compressible seals 38 may be attached to vent members 36 prior to placing them on corrugated roof 30 using adhesive material 50 located on the top surfaces 44 of compressible seals 38 or an adhesive (not shown) on the bottom of vent members 36. An adhesive material (not shown) may also be placed on the top surface of vent members 36 or the bottom side of ridge cap 34 for preassembly of the vent members to the ridge cap.

Once in place, the upper vent assembly is compressed as shown in FIG. 7 so that the compressible seal 38 seals around peaks 52, sloped regions 56, and low regions 54 of the corrugated roof. Slits 48 enable the compressible seals 38 to conform to the configuration of the corrugated roof 30 and provide a good environmental barrier even though prior to assembly, the compressible seals do not match the roof contour. Upper venting region 14 is then held in place by inserting screws or bolts (not shown) through the assembly or using other attachment means known in the metal building industry.

In operation, roofing system 12 provides an efficient cost-effective means for venting air and moisture from a metal building. Even though a plastic sheet or other barrier is typically placed beneath the blanket of insulation 64, moisture can still propagate into the area between insulation 64 and corrugated roof 30 through openings in the plastic sheet where attachments are made or through tears. As discussed above, if this moisture is left to remain, it may degrade the insulation and cause corrosion to the roof. The insulating vent blocks 60 allow free movement of air and moisture in this region. This allows the moisture to escape through ridge opening 35, out vent members 36, and to the exterior of the building. Likewise hot air, heated from the sun, may likewise pass through the insulating vent blocks, out ridge opening 35 and through vent members 36 to make the building more energy efficient and reduce cooling costs.

Vent blocks 60 also provide an insulating function to prevent heat or cold from being transferred along the roof attachment regions from corrugated roof 30 through the compressed insulation into the purlins. The insulating capability of the vent blocks is enhanced by the air space created by air passages 72, and the polypropylene material of the vent blocks also inhibits heat transfer. It should also be noted that the design and configuration of the insulating vent blocks are such that the blocks are strong enough to support the roof thereon and any assemblers or maintenance workers who may be on the roof.

Although the invention may be utilized without shield 62, the shield provides several distinct advantages. If, as in the embodiment described, shield 62 is made from and in the same manner as the insulating vent blocks, the shield will provide additional venting and insulation capabilities to the assembly. Shield 62 also serves to prevent insulation 64 from fluffing or billowing around the vent block 60 when it is compressed during the attachment of the roof, as is shown occurring around the insulation blocks in FIG. 5 of U.S. Pat. No. 5,495,698 to Alderman, et al. As should become evident, if the insulation does billow around the vent blocks, it will obstruct the air passages and decrease the efficiency of the venting capability. The shield prevents the insulation from billowing around the vent blocks and blocking the air passages 72 because the width $W_3$ of the shield is wider than the width $W_2$ of the vent block holding the insulation back from the air passages.

In an alternate embodiment, an upper venting region generally indicated as 14*a* is shown in FIG. 6. Upper venting region 14*a* is similar to venting region 14 in all respects except that it includes a movable valve member generally indicated as 82. In the embodiment shown, the movable valve member includes a sheet of thin rubberized or plasticized material 84 with a deflectable bubble 86 attached to the end thereof. The manufacturing, placement and use of the movable member is detailed in U.S. Pat. Nos. 5,921,863 and 6,213,868, both granted to Applicant and incorporated herein by reference.

Figure 12A:
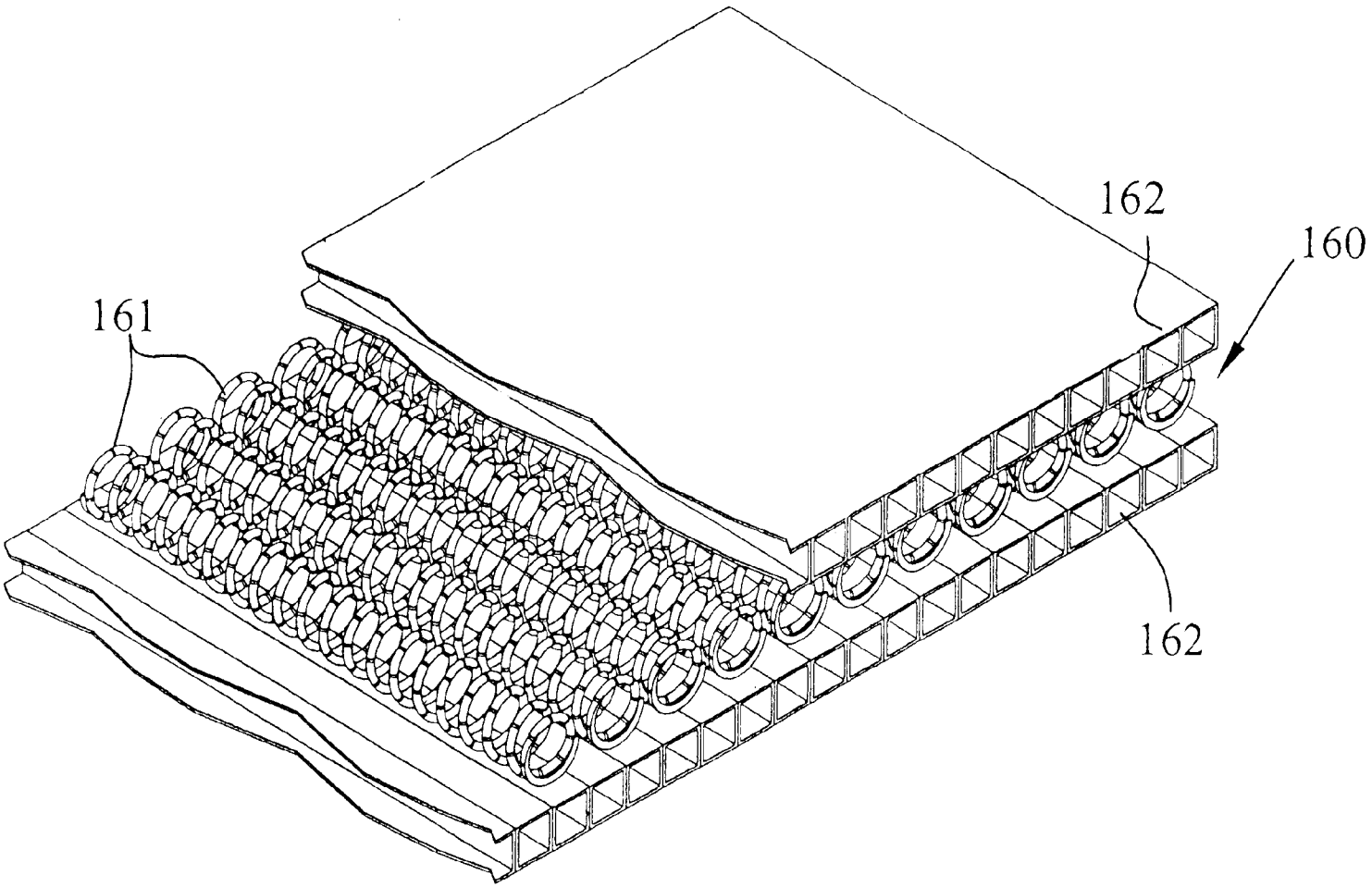
FIGS. 12A–F are alternate venting configurations for use in the insulating purlin vent.

Referring to FIGS. 12A–F, alternate insulating vent blocks are shown which may be substituted for insulating vent block 60. In FIG. 12A, an insulating vent generally indicated as 160 includes a series of spiraled rings or coils 161 sandwiched between a pair of extruded co-polymer layers 162. In one embodiment, co-polymer layers 162 are made from extruded polypropylene, the same as vent blocks 60 and shield 62 as discussed above. Of course, other materials such as sheets of metal, wood, or plastic may also be suitable for framing any of the alternate insulating vents depicted in FIGS. 12A–F. Coils 161 may be manufactured from any metal or plastic material that provides sufficient strength to support corrugated roof 30 and any assemblers thereon.

Figure 12B:
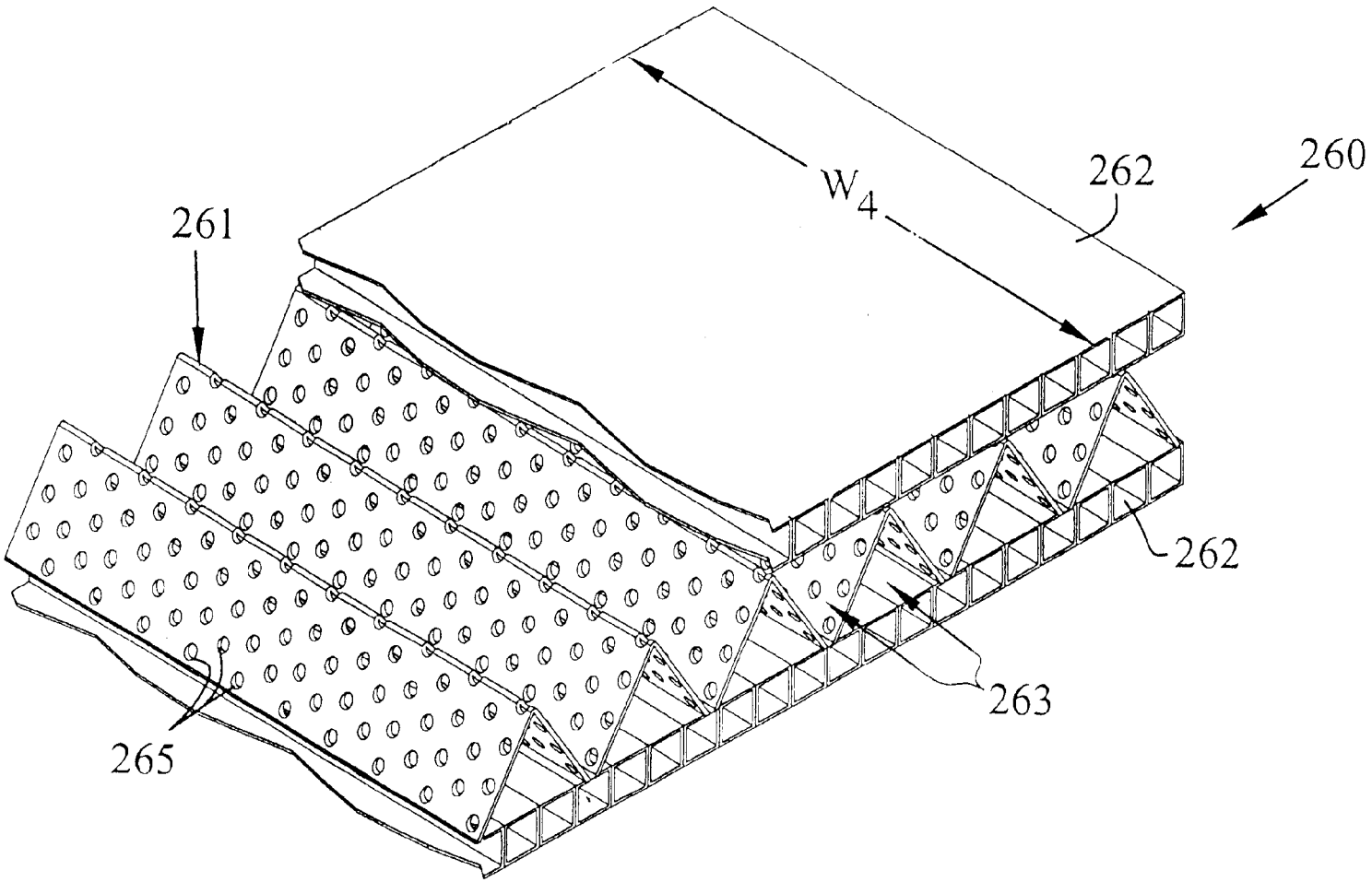

Referring to FIG. 12B, another alternate insulating vent is shown generally indicated as 260. Insulating vent 260 includes a folded metal sheet 261 and a pair of co-polymer layers 262. Folded metal sheet 261 defines a plurality of prism-shaped air passages 263 extending across the width $W_4$ of insulating vent 260 and also includes a plurality of throughholes 265 that allow air and moisture to vent transversely to air passages 263.

Figure 12C:
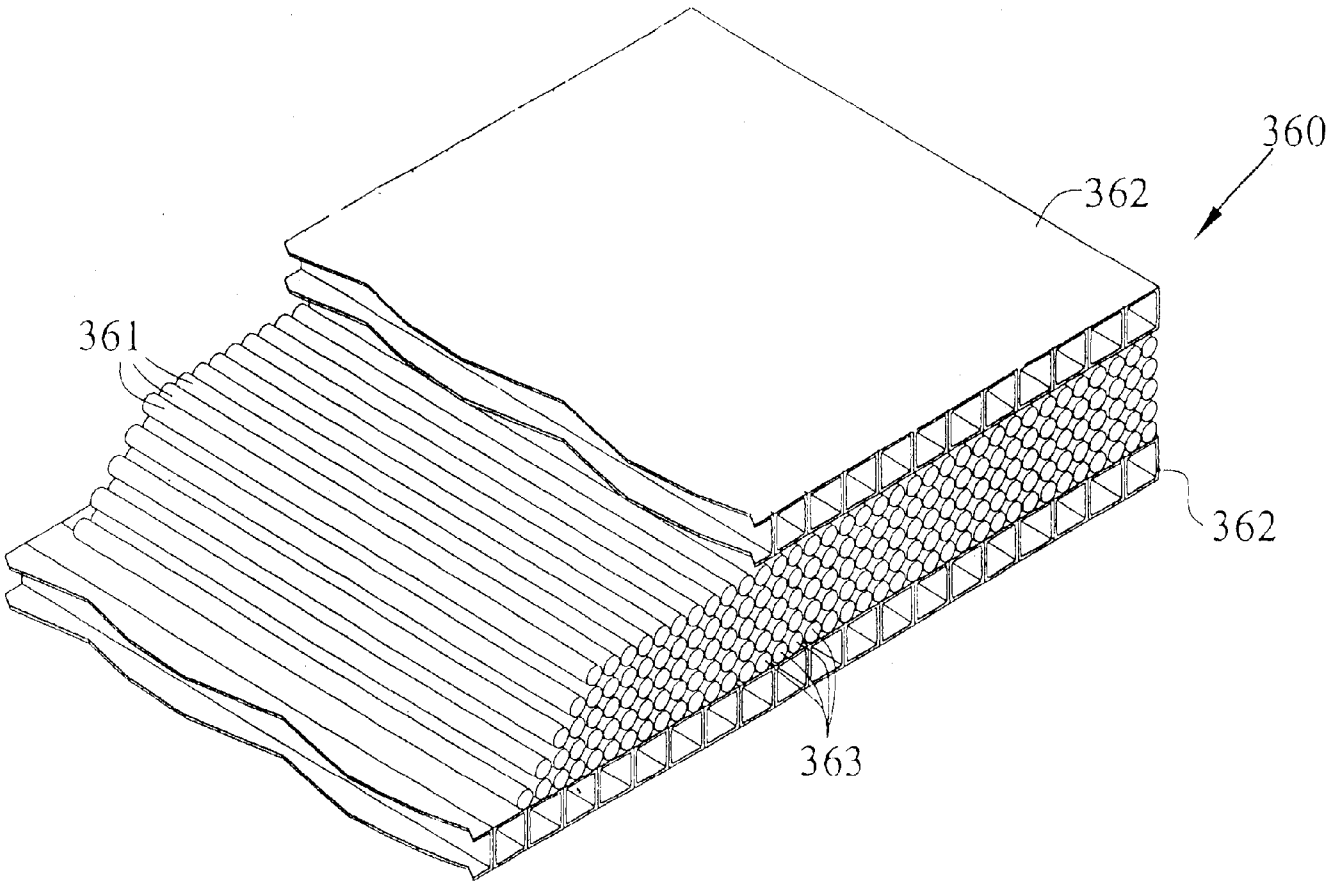

In FIG. 12C, an insulating vent generally indicated as 360 has a plurality of stacked tubes or straws 361 sandwiched between a pair of co-polymer layers 362. Tubes 361 may be made from a suitable metal or plastic material to define air passages 363 extending across insulating vent 360.

Figure 12D:
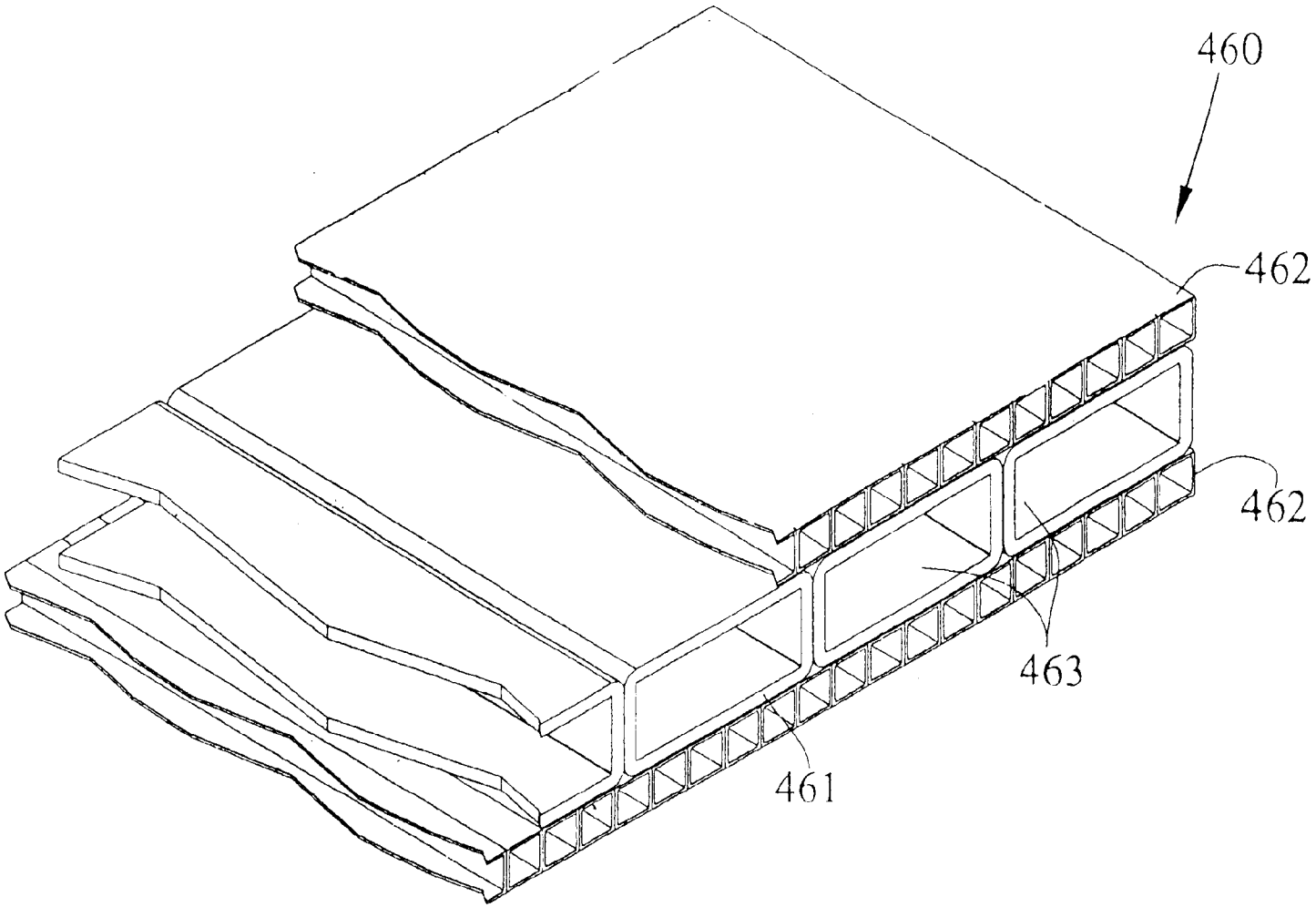

In FIG. 12D, an insulating vent generally indicated as 460 includes a plurality of rectangular channels 461 that are sandwiched between a pair of co-polymer layers 462 and define air passages 463 that extend across the vent. Rectangular channels 461 may be manufactured from any suitable material such as metal or plastic that will provide sufficient strength properties for supporting the roof and any assemblers thereon.

Figure 12E:
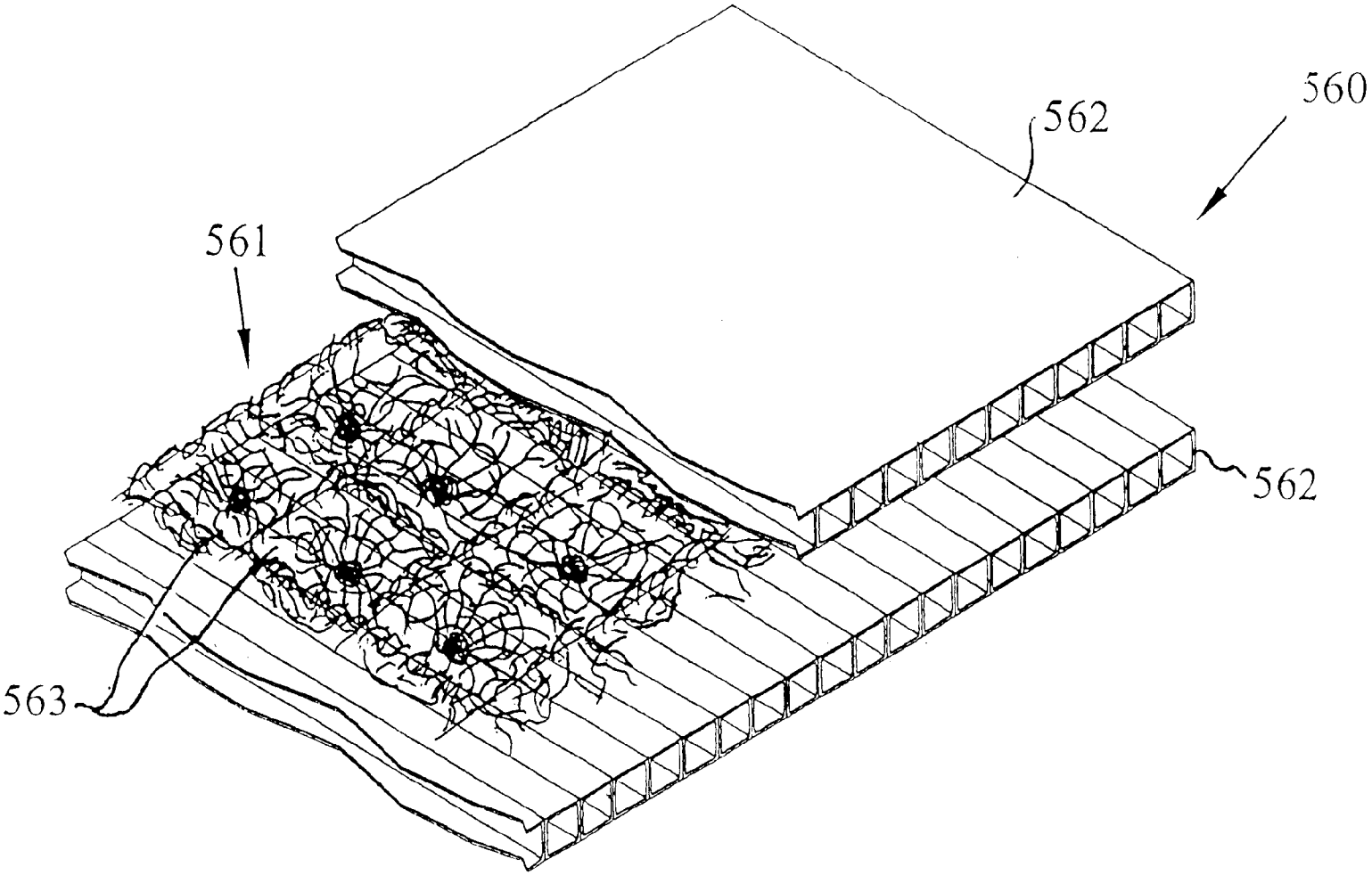
Figure 12F:
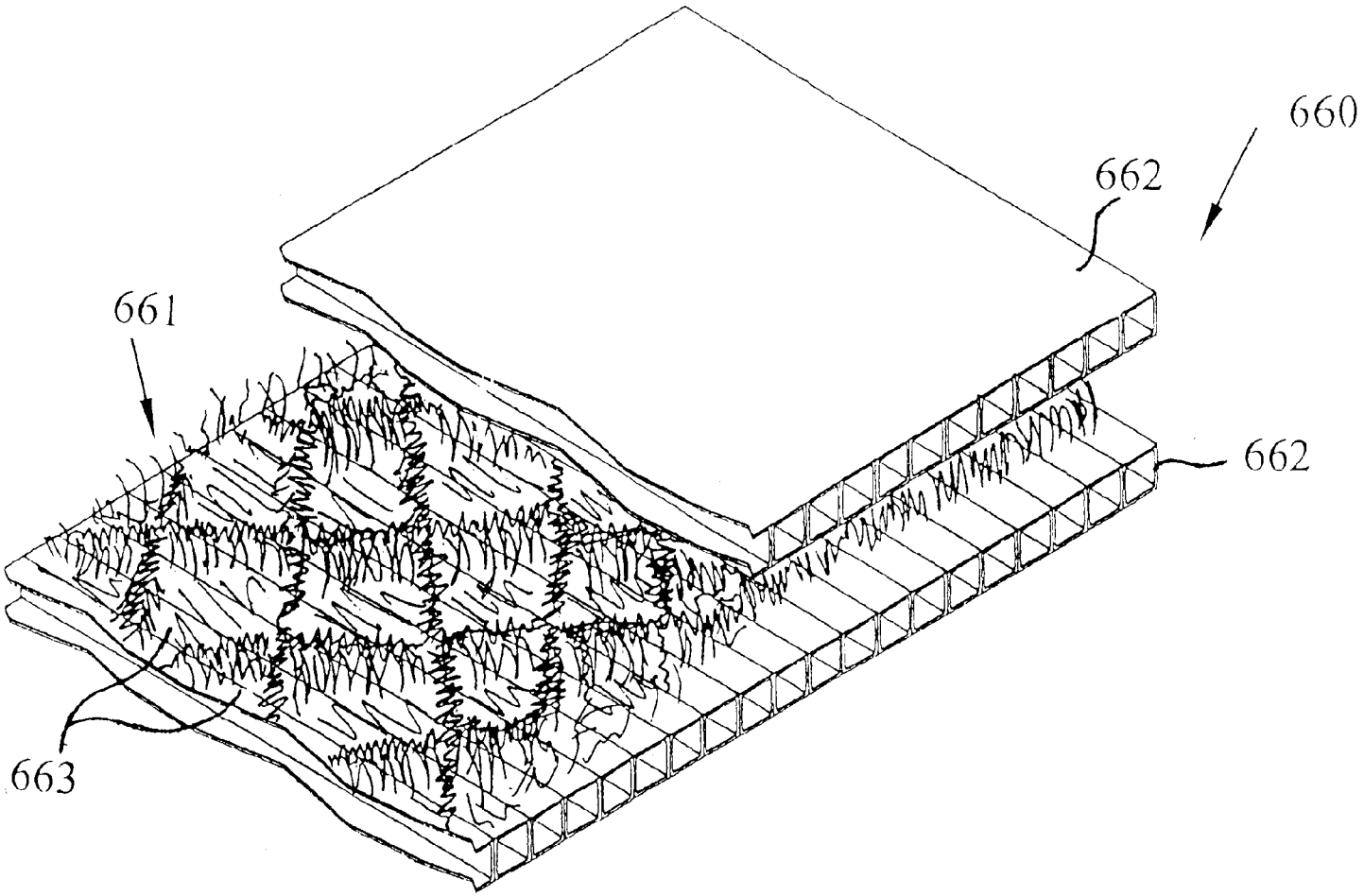

In FIGS. 12E and 12F, insulating vents are generally indicated as 560 and 660, respectively. Insulating vents 560 and 660 each have a venting region 561 and 661, respectively, manufactured from a plastic or metal wire array. Wire arrays 561 and 661 are sandwiched between co-polymer layers 562 and 662, respectively. The array of vent region 561 defines a plurality of generally square or rectangular areas 563, while the wire arrays in venting region 661 form a plurality of diamond-shaped region 663. Wire arrays in both venting regions 561 and 661 are stiff enough to provide support for corrugated roof 30 and any assemblers thereon, yet the wires are spaced far enough to allow air and moisture to transfer across the insulating vents.

Figure 13:
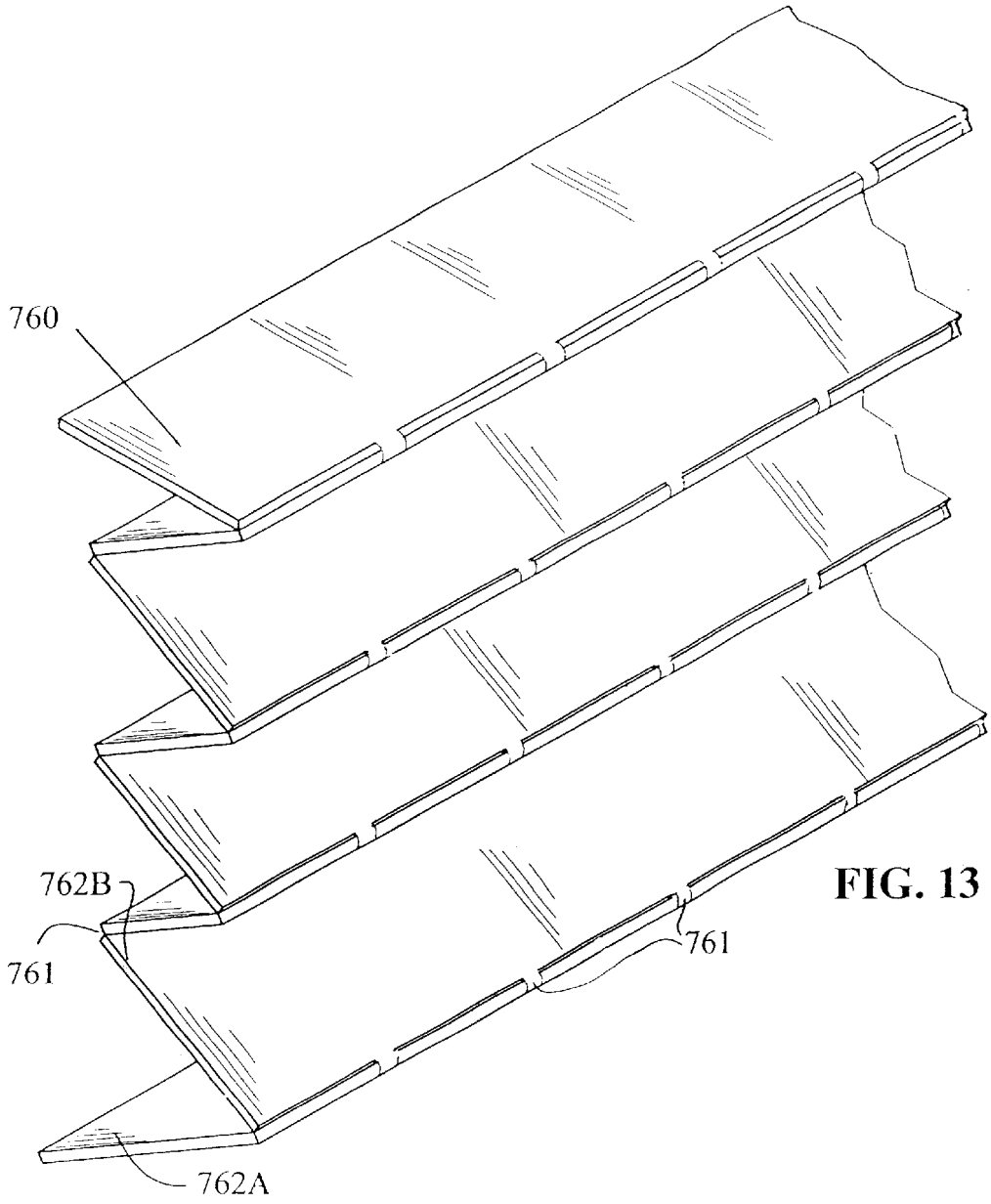
FIG. 13 is an exploded perspective view of an alternate embodiment of a combined insulating vent block and shield.
Figure 14:
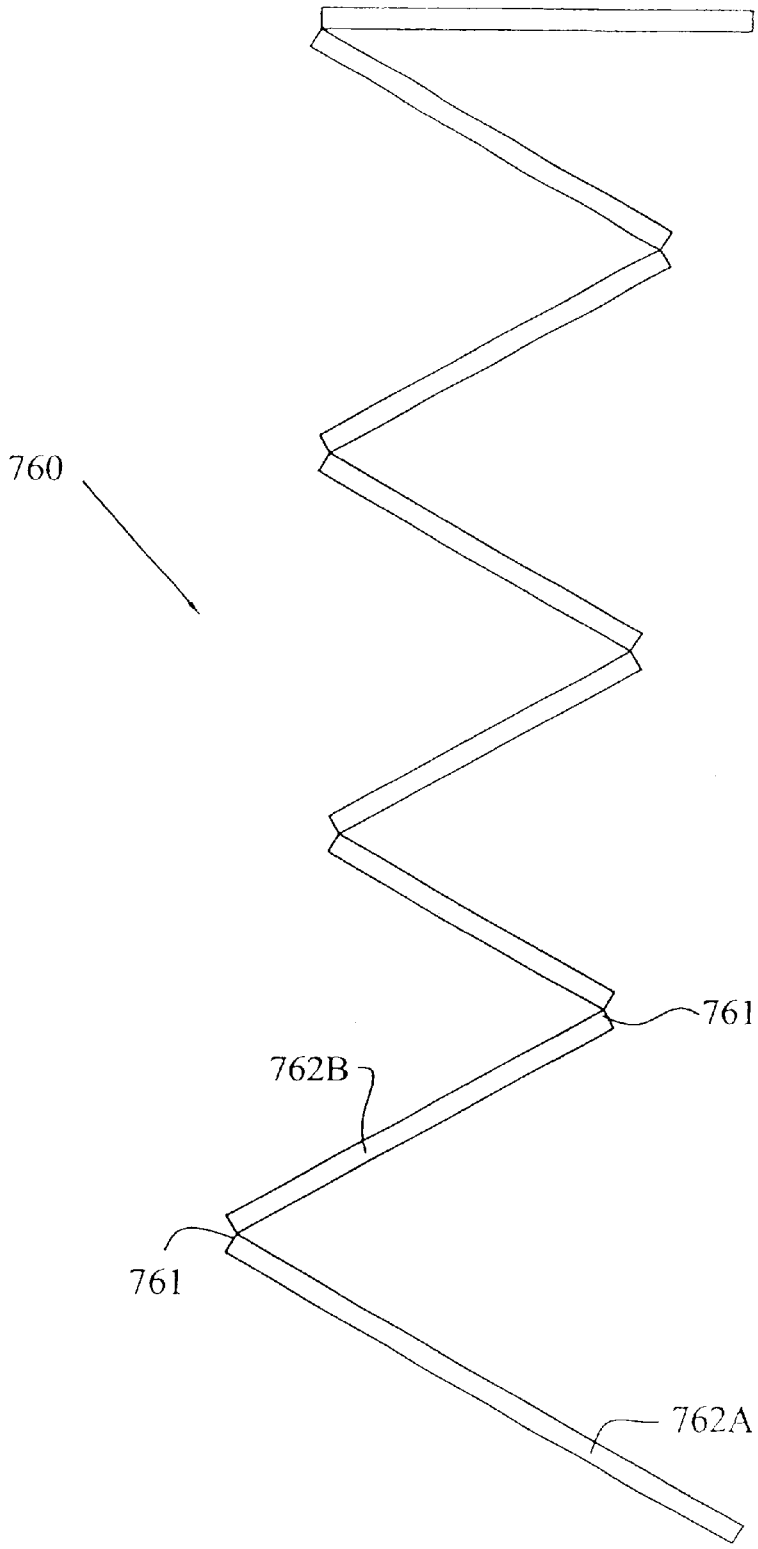
FIG. 14 is an exploded end view of the combined insulating vent block and shield of FIG. 13.
Figure 15:
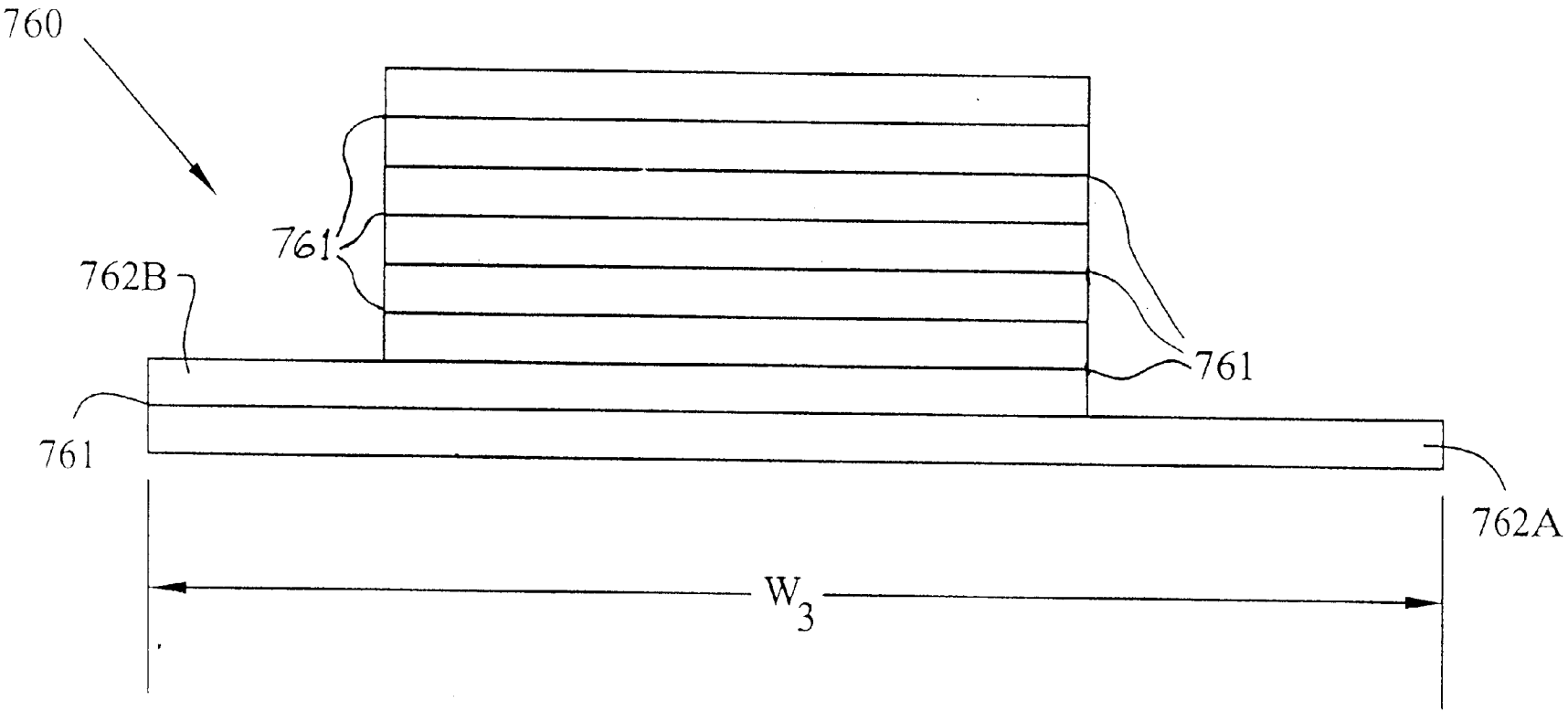
FIG. 15 is an end view of the combined insulating vent block and shield as folded together.

In FIGS. 13–15, an alternate embodiment is shown, wherein the insulating vent block and shield are combined as a single unit as generally indicated by 760. In one embodiment, the block and shield are manufactured from extruded polypropylene as with the separate vent block 60 and shield 62; however, each layer of the combined vent block and shield 760 is joined by a hinged connection 761. Hinged connections 761 may be formed using the well-known "slit-scored" or "nick-scored" techniques as described in U.S. Pat. No. RE37,388 for a RIDGE CAP TYPE ROOF VENTILATOR to Kasner, et al., incorporated herein by reference. In the embodiment depicted in FIG. 15, it can be seen that this method of manufacturing the combined vent block and shield will result in the shield having a bottom layer 762*a* that extends for the full width $W_3$ of the shield, and a second layer 762*b* that extends for only a portion of the width of $W_3$, yet is wider than width $W_2$ of the vent block.

The embodiments of the invention described herein are not intended to be exhaustive or to limit the invention to the precise forms disclosed. Rather, the embodiments selected for description have been chosen to enable one skilled in the art to practice the invention. Changes may be made in form and detail to the roofing ventilation system without departing from the spirit and scope of the invention. For example, while a typical configuration has been depicted for a corrugated roof, this invention will also work with other roof configurations used in the industry. Likewise, Z-shaped purlins have been shown for supporting the roof, but the invention will work with C-shaped channels, I-beams or other support structures.

Furthermore, vent members 36 and insulating vent blocks 60 have been shown with air passages having a square or rectangular cross-section; however, a wavy member may be used between the planar plies as is well known in the industry instead of cross plies 70. Other co-polymer materials such as polyethylene may also be used to make the ventilation members and vent blocks. Additionally, vent members 36 may be manufactured as a single piece having a hinged center as shown in U.S. Pat. No. 5,921,863 to the Applicant, such that the vent members include a connecting portion that spans ridge opening 35.

Additionally, although the embodiment described utilizes an open-celled foam material for the compressible seal because it provides excellent compressibility and when compressed provides the desired environmental barrier, it is also contemplated to use closed-cell foam or other materials that have sufficient compressibility and will provide a suitable barrier. It is also contemplated to vary the slits in the compressible seal. The invention may be practiced using slits having a different spacing, orientation or length from that depicted. Also, although the shield depicted provides additional venting and insulation to the system, the shield may also be made from a sheet of wood, metal, or other materials with sufficient rigidity. The scope of the invention is therefore defined by the attached claims rather than limited to the embodiments depicted.

What is claimed is:

1. A roofing system for use with a metal building, said roofing system comprising: a corrugated roof being formed from a metallic material, said corrugated roof having a non-planar shape including a plurality of rises having peaks and a plurality of declines having valleys; a ridge cap configured to cover a ridge opening in said corrugated roof of the metal building, said ridge cap providing protection for said building; a plurality of purlins, said purlins being attached to roofing frame members of the building and in succession forming a base for said roofing system; a ventilation member located between said ridge cap and said corrugated roof for allowing air and moisture to vent out of the metal building through said ridge opening; a compressible seal having a plurality of slits, said compressible seal providing a seal between said corrugated roof and said ventilation member such that said compressible seal is most compressed at said peaks and more expanded at said valleys, said slits being pressed against said corrugated roof to allow said compressible seal to be configurable to said peaks and said valleys; a compressible insulation material to reduce heat transfer through the roof of the building, said insulation material being located between said purlins and said corrugated roof; and an insulating vent disposed between said corrugated roof and said insulation material, said insulating vent facilitating transfer of air and moisture that is beneath said corrugated roof and above said insulation material to allow the air and moisture to vent out of said ridge opening and through said ventilation member to the exterior of the metal building.

2. The roofing system for use with a metal building as set forth in claim 1, further including an insulation shield disposed between said insulating vent and said insulation material, said shield width being greater than said insulating vent such that said insulation material is prevented from billowing up around and reducing air flow through said insulating vent.

3. The roofing system for use with a metal building as set forth in claim 2, wherein said insulation shield further includes a plurality of air passages to provide additional venting capacity to said insulating vent to increase the venting efficiency of the roofing system.

4. The roofing system for use with a metal building as set forth in claim 2, further including a plurality of affixing members for use in assembling said roofing system.

5. The roofing system for use with a metal building as set forth in claim 3, further including a movable closure member disposed between said compressible seal and said ventilation member, whereby when wind exceeds a predetermined value, said movable member moves from a first position allowing air to vent out of said ventilation member to a second position closing said ventilation member to preclude moisture and contaminants from entering the metal building through the ridge opening.

6. The roofing system for use with a metal building as set forth in claim 1, wherein said compressible seal is formed from an open-celled foam material.

7. The roofing system for use with a metal building as set forth in claim 1, wherein said slits extend in a direction substantially parallel to a longitudinal direction along said peaks and valleys.

8. The roofing system for use with a metal building as set forth in claim 7, wherein said slits are spaced apart across the length of the compressible seal and said slits are substantially perpendicular to said ridge opening.

9. The roofing system for use with a metal building as set forth in claim 1, wherein said insulating vent includes a plurality of air passages extending substantially perpendicular to the ridge opening.

10. A roofing system comprising: a corrugated roof having a ridge opening and a non-planar shape; at least one ventilation member extending longitudinally across said roofing system; and a compressible seal having a plurality of slits along the length thereof, said compressible seal being disposed between said ventilation member and said corrugated roof, whereby said compressible seal conforms to said non-planar shape and provides a barrier to prevent contaminants from entering the ridge opening through an area between said ventilation member and said corrugated roof.

11. The roofing system as set forth in claim 10, wherein said compressible seal is formed from open-celled foam.

12. The roofing system as set forth in claim 10, wherein said ventilation member includes a plurality of air passages extending therethrough, whereby air and moisture may vent from said roofing system.

13. The roofing system as set forth in claim 10, further including a roof cap extending longitudinally across said roofing system over top of the ridge opening in said corrugated roof.

14. The roofing system as set forth in claim 13, wherein said ventilation member is located between said roof cap and said compressible seal.

15. The roofing system for use with a metal building as set forth in claim 14, further including a movable closure member disposed between said compressible seal and said ventilation member, whereby when wind exceeds a predetermined value, said movable member moves from a first position allowing air to vent out of said ventilation member to a second position closing said ventilation member to preclude moisture from entering the metal building through the ridge opening.

16. The roofing system as set forth in claim 11, wherein said compressible seal includes an adhesive, said adhesive abutting a bottom surface of said ventilation member to hold said compressible seal and said ventilation member together during installation.

17. The roofing system as set forth in claim 10, wherein said corrugated roof is fixed to a lower roofing portion including a venting insulation block, an insulation material, and mounting members all joined by a plurality of affixing members.

18. The roofing system as set forth in claim 17, wherein said mounting members include a plurality of purlins having a substantially "Z" shape.

19. The roofing system as set forth in claim 18, wherein said venting insulation block is disposed between said mounting members and said corrugated roof, said affixing members retaining said venting insulation block in a given position, whereby said insulation block reduces heat transfer from said corrugated roof to said mounting members.

20. The roofing system as set forth in claim 19, wherein said venting insulation block includes a plurality of air passages providing a means for air and moisture to vent from an area between said corrugated roof and said insulation material.

21. The roofing system as set forth in claim 20, wherein said insulation material is disposed between said venting insulation block and said mounting members, whereby said insulation material reduces heat transfer through said roofing system.

22. The roofing system as set forth in claim 21, wherein an insulation shield is disposed between said venting insulation block and said insulation material, said insulation shield having a greater width than said venting insulation block to prevent said insulation material from billowing about said venting insulation block and reducing air flow therethrough.

23. An insulated roofing system comprising: a corrugated roof, mounting members for affixing said insulated roofing system to a structure; a compressible insulation material capable of reducing heat transfer, said insulation material being disposed between said mounting members and said corrugated roof, and at least one venting insulation block being disposed between said insulation material and said corrugated roof, said venting insulation block having a plurality of air passages allowing air and moisture to be vented therethrough, whereby said venting insulation block reduces heat transfer between said mounting members and said corrugated roof when said insulation material is compressed to attach said corrugated roof to said mounting members.

24. The insulated roofing system as set forth in claim 23, further comprising an insulation shield extending beyond the ends of said venting insulation block, said insulation shield being located between said venting insulation block and said insulation material, whereby said insulation shield prevents said insulation material from obstructing said air passages.

25. The insulated roofing system as set forth in claim 24, further including a ventilation member and a compressible seal, said corrugated roof being non-planar and having a shape including a plurality of rises and a plurality of valleys, said plurality of rises leveling at a plurality of summits, said ventilation member being fixed to said corrugated roof at said summits.

26. The insulated roofing system as set forth in claim 25, wherein said compressible seal is disposed between said corrugated roof and said ventilation member, whereby said compressible seal conforms to said shape of said corrugated roof.

27. The insulated roofing system as set forth in claim 26, wherein said compressible seal is formed from an open-celled foam material.

28. The insulated roofing system as set forth in claim 27, wherein said compressible seal includes a plurality of slits, whereby said slits are in contact with said corrugated roof facilitating said compressible seal conforming to said corrugated roof.

29. The insulated roofing system as set forth in claim 23, wherein the venting insulation block includes a plurality of planar plies and at least one ply extending between each adjacent pair of planar plies.

30. The insulated roofing system as set forth in claim 29, wherein the venting insulation block has a plurality of layers of planar plies stacked upon each other and adjacent layers are hingedly connected to one another.

31. The insulated roofing system as set forth in claim 30, further including an insulation shield extending beyond ends of said venting insulation block, said insulation shield being located between said venting insulation block and insulation material, whereby said insulation shield prevents said insulation material from obstructing said air passages, and said insulation shield is hingedly connected to said venting insulation block.

* * * * *